US005085275A

United States Patent [19]

Gondouin

[11] Patent Number: 5,085,275

[45] Date of Patent: Feb. 4, 1992

[54] PROCESS FOR CONSERVING STEAM QUALITY IN DEEP STEAM INJECTION WELLS

[75] Inventor: Michel Gondouin, San Rafael, Calif.

[73] Assignee: S-Cal Research Corporation, San Rafael, Calif.

[21] Appl. No.: 512,317

[22] Filed: Apr. 23, 1990

[51] Int. Cl.[5] ..... E21B 43/24; E21B 43/40

[52] U.S. Cl. ..... 166/303; 166/50; 166/266; 166/272

[58] Field of Search ..... 166/50, 303, 272, 263, 166/372, 266, 267

[56] References Cited

U.S. PATENT DOCUMENTS

| | | | |
|---|---|---|---|
| 3,312,281 | 4/1967 | Belknap | 166/303 |
| 3,373,805 | 3/1968 | Boberg | 166/303 |
| 3,438,442 | 4/1969 | Pryor et al. | 166/303 |
| 3,525,399 | 8/1970 | Bayless et al. | 166/303 |
| 4,160,481 | 7/1979 | Turk et al. | 166/303 X |
| 4,201,420 | 5/1980 | Likholai et al. | 166/303 X |
| 4,257,650 | 3/1981 | Allen | 166/303 X |
| 4,598,770 | 7/1986 | Shu et al. | 166/50 X |
| 4,718,486 | 1/1988 | Black | 166/372 X |

*Primary Examiner*—Stephen J. Novosad

[57] ABSTRACT

The degradation of steam quality due to heat losses prior to its injection into a heavy oil reservoir is reduced by a process utilizing the heat contained in a stream of reservoir fluids produced from the same reservoir, following a cycle of steam injection. These hot reservoir fluids are produced from one of several horizontal drainholes connected to the same vertical cased well, while at least one of the other drainholes is under cyclic steam injection. Steam from a boiler located in close proximity of the well head is conveyed downhole through an insulated tubing to a Downhole Valve Section used to direct the flow of steam from the steam tubing to each of the drainholes in succession and to direct the flow of reservoir fluids from the previously steam-injected drainholes to the production tubing. Both tubings are installed within the casing of the vertical well and each of them is dedicated to carrying only one type of fluid: steam or reservoir fluids. Only the drainhole liners see an alternance of steam and of reservoir fluids. The heat contained in fluids supplied from the surface for lifting the produced fluids to the surface is also used to reduce heat losses from the steam tubing to the cold rocks surrounding the well. The heat loss reduction is achieved by reducing the temperature gradient across the insulation layer of the steam tubing. Detrimental heat losses through the well casing can also be reduced by using an insulated production tubing, concentric with the central insulated steam tubing.

16 Claims, 9 Drawing Sheets

STEAM
OIL
50
A
55
B
55
7
6

STEAM
OIL
50
A
55
B
55
7
6

PROCESS FOR CONSERVING STEAM QUALITY IN DEEP STEAM INJECTION WELLS

FIELD OF THE INVENTION

The application of steam injection for the recovery of heavy oil is presently limited to relatively shallow reservoirs, because heat losses in steam lines at the surface and through the well tubing become excessive in deep wells. These heat losses result in a drastic reduction of the steam quality of the mixture of water, steam and sometimes gases and foams injected into the heavy oil zone. Steam quality, which is about 75% at the boiler outlet, may drop to less than 20% at the bottom of some deep injection wells. This reduces considerably the heat input into the reservoir and reduces the benefits of the steam injection process to the point where it becomes uneconomic. The low Oil/steam ratio characterizing such an unsuccessful operation, leads to the early abandonment of wells and to a low ultimate recovery of the oil originally in place in the reservoir. The present invention is aimed at correcting this problem, by a combination of techniques to reduce heat losses from steam along its flow path before it enters the reservoir, and by maximizing its beneficial effects within the reservoir. This is made possible by using a novel combination of various new techniques and equipments, including a downhole valve section, described in a companion patent application Ser. No. 510,596, filed Apr. 18, 1990.

BACKGROUND AND SUMMARY OF THE INVENTION

Most of the heavy oil produced by steam injection techniques is obtained from wells operated in the cyclic, or "huff and puff" mode. Even those reservoirs under continuous injection, or steam flood, are usually started on production in the "huff and puff" mode, so as to develop first a hot zone of mobile oil in the reservoir in the immediate vicinity of the injection and production wells to be used later in the steam flood. This hot zone of mobile oil effectively increases the steam deliverability of the injection wells and the oil productivity of the production wells in the steam flood. This first step is particularly advantageous in the case of high-viscosity Heavy Oil reservoirs of relatively low permeability, where the injection of large volumes of steam would be precluded by the small effective radius of the wells. The creation of a hot mobile oil zone around the wells by the earlier "huff and puff" mode of operation gradually increases the effective radius of the wells. Another technique to address the same problem is to increase the surface of contact of the well with the reservoir, by using highly deviated or horizontal wells rather than vertical wells. These advantages are fully retained in the present process and several other advantages are added.

To reduce the heat loss from surface lines, these are insulated and mounted on supports above ground, whenever possible. This is, however, not possible in populated areas, where high pressure steam lines must be buried. Any thermal insulation in such buried lines must be protected from ground water and therefore requires two concentric pipes. This adds significantly to the cost of facilities when such surface lines are long, as in the case of conventional "huff and puff" operations in a field where wells are drilled on a relatively large spacing.

To reduce tubing heat losses, various thermal insulation techniques are also available, but their effectiveness is limited and their cost is high. This explains why steam injection techniques are presently limited to relatively shallow reservoirs. The present invention relaxes this depth limitation.

Large amounts of Heavy Oil have been discovered offshore under deep water and in the Arctic, under the Permafrost. In either case, heat losses through the well casing may be prohibitive, even when insulated tubings are used. This is why steam injection techniques have not been used in these cases, even when reservoir characteristics are favorable for the recovery of oil by application of such techniques. An embodiment of the present invention overcomes this problem.

The present invention takes advantage of the fact that, following a cycle of steam injection, the reservoir fluids produced in the "puff" part of the "huff and puff" mode of operation are very hot when they enter the bottom of the tubing, on their way to the surface. These produced fluids consist of hot oil, steam condensate and formation water, and gas associated with the oil. Their temperature is lower than that of the injected steam but it is still much higher than that of the rocks surrounding the well casing. The present invention provides the means of having, within the same casing, two tubings respectively carrying steam in downward flow and produced fluids in upward flow at the same time and exchanging heat between each other, as a way of offsetting the heat loss from the steam tubing to the surrounding casing and rocks.

In conventional "huff and puff" operations, the same well tubing, which may or may not be insulated, is used successively to transport steam in the first part of the cycle and produced fluids in the second part of the cycle, in discontinuous flow, first downward and later upward. Due to the discontinuous nature of the steam injection, the same boiler usually serves several injection wells, by means of a network of steam lines at the surface, which contribute to the degradation of steam quality.

On the contrary, in this novel process, two tubings, located within the same well casing, remain dedicated each to only one fluid, flowing continuously in a single direction. The steam tubing is always insulated and the temperature on the outer surface of its insulation is determined by that of the hot produced fluids flowing upwards rather than by that of the casing and surrounding rocks.

This reduces the temperature gradient across the insulation, so as to minimize the heat loss from the steam across the insulation layer. The unavoidable heat loss to the casing and to the cement and cold surrounding rocks is supplied mainly from the heat of the produced fluids stream. Consequently the steam quality of the injectant mixture arriving at the bottom of the steam tubing is much greater than in the conventional "huff and puff" process. This results in an increase of the oil/steam ratio, which is the essential economic parameter of any steam injection process.

This desirable result, which allows the continuation of oil production from wells otherwise uneconomic under the conventional mode of operation, also allows to produce heavy oil from deeper reservoirs for which conventional techniques would lead to excessive degradation of the steam quality and from offshore wells at great water depth, which are presently unexploited. It is achieved by using at least two horizontal drainholes, connected to the same vertical cased well and by using a novel Downhole Valve Section of the type described in the companion application Ser. No. 510,596, filed on Apr. 18, 1990. This Section consists of a set of tubular flow paths connected respectively to the drainholes at one end and to the tubular goods respectively carrying produced fluids and steam, at the other end of said Section. Novel retrievable multi-way downhole valves located within these flow paths and controlled from the surface allow to connect each of the drainholes to either the steam tubing or the production tubing and vice versa in successive cycles, so that each drainhole operates in the "huff and puff" mode while each tubing remains dedicated to the flow of the same type of fluids in a constant direction, on a continuous basis.

The same process and equipment, which includes boiler and production facilities preferably dedicated to a single vertical well and its connected drainholes, largely reduces the need for long steam lines and flow lines at the surface, thus further reducing heat losses and capital costs per barrel of oil produced.

Following a period of "huff and puff" operation, the drainholes within the field may be easily converted to the steam flood mode of operation, without any change in facilities.

Finally, an important advantage of the present process over the conventional "huff and puff" steam injection techniques is that the temperature of all the tubular goods in the vertical well remains essentially constant while the drainholes are in the "huff and puff" mode. This greatly reduces the maintenance cost of the well, because most of the expense in the conventional process is directly attributable to the periodic variations in thermal stresses and in thermal expansion of those tubular goods. Such variations are the source of leaks at the well head and in both the surface steam and production flow lines, requiring constant monitoring and frequent repairs.

Oil-soluble gases and/or foam additives may be used in conjunction with steam in the present process to provide additional oil recovery, according to known processes.

BRIEF DESCRIPTION OF THE FIGURES

FIGS. 7 and 8*a*, 8*b* and FIGS. 7*a*, 7*b*, 7*c*, 8*c* and 8*d* are cross sections respectively vertical and horizontal of two types of Downhole Valve Sections described and claimed in the companion patent application Ser. No. 510,596, filed Apr. 18, 1990, where they are numbered respectively 11, 13*a* and 13*b* for the vertical cross sections and 11*a*, 11*b*, 11*c*, 13*c* and 13*d* for the horizontal cross sections. These are given only as an illustration of the type of equipment which may be used in the present process, which is not limited to using these specific devices.

DETAILED DESCRIPTION OF THE FIGURES

Figure 1:
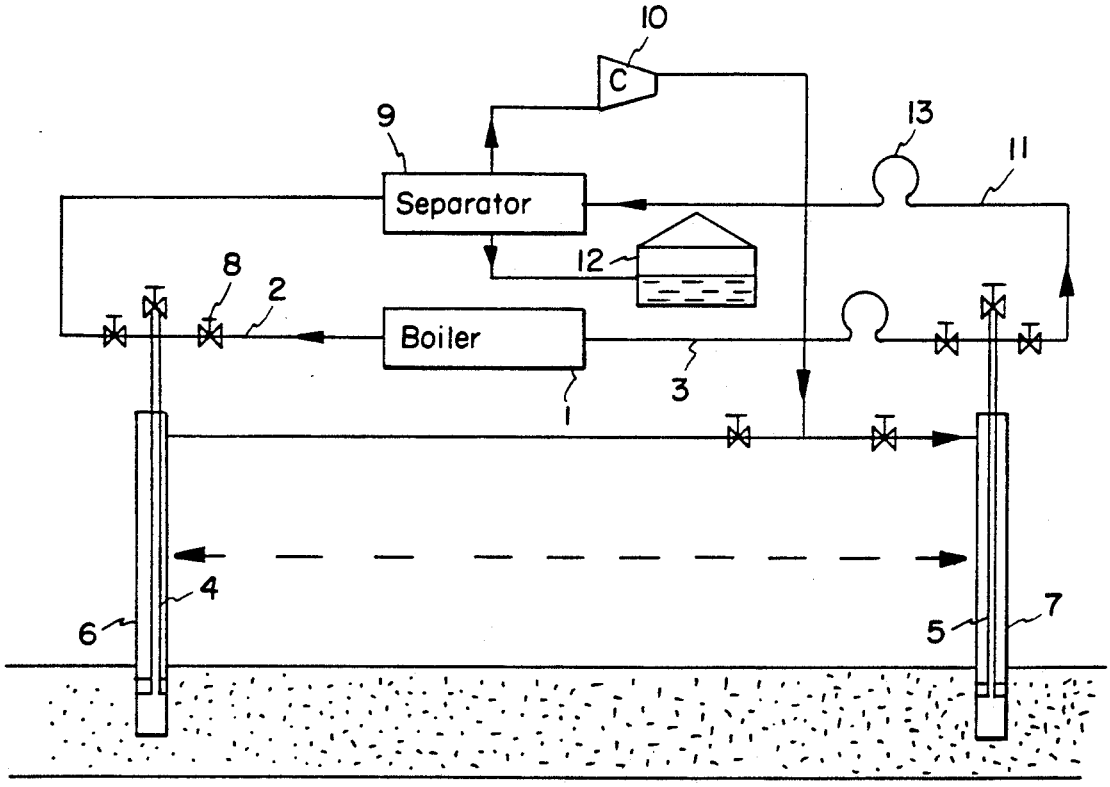
FIG. 1 PRIOR ART
FIG. 1 is a schematic diagram showing the facilities required for a conventional "huff and puff" steam injection operation in a reservoir with a 20 acres well spacing. This figure is labelled Prior Art to distinguish it from the present invention.

FIG. 1 shows the conventional application of "huff and puff" steam injection techniques in a field where wells are on a 20 acre spacing. A boiler (1) is connected to two surface steam lines (2) and (3) supplying alternatively the tubings (4) and (5) of two vertical cased wells (6) and (7). By means of surface valves (8), steam is directed first to well 6 then to well 7. Conversely, separator facilities (9) and a gas compressor (10) handle in a first part of the cycle the produced fluids from well 7 and later those from well 6. These produced fluids are transported in surface flow lines (11) and the separated oil is sent to a storage tank (12). All surface lines transport hot fluids and their thermal expansion must be taken by appropriate expansion loops (13) or equivalent devices. The separator facilities include three-phase separators, heater-treaters and a water-removal unit on the separated gas stream, delivering dry and dehydrated gas.

TABLE 1

Figure 2:
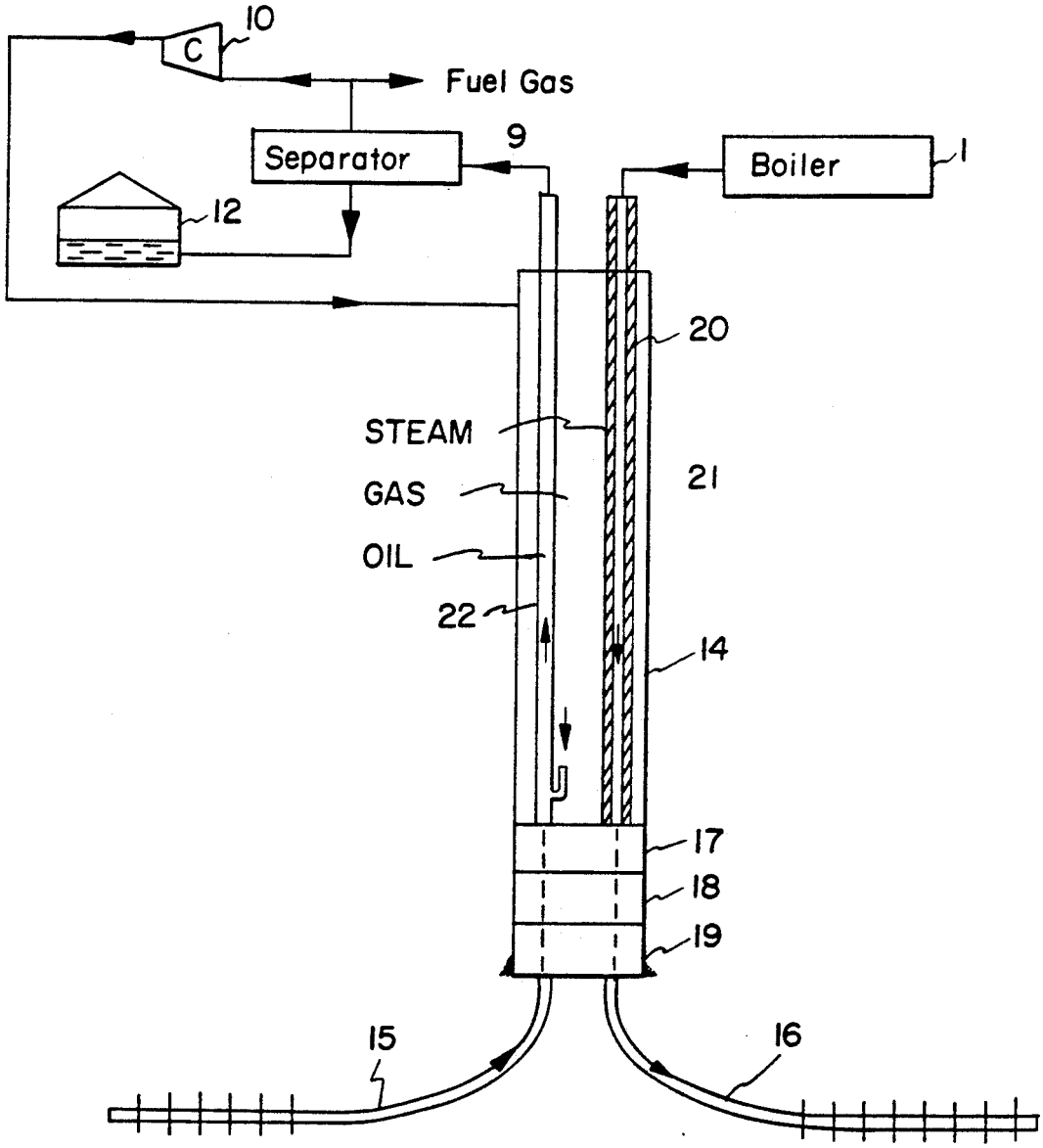
FIG. 2 is a schematic diagram of the facilities required for the present process under the same reservoir conditions, for comparison with FIG. 1.
Figure 3:
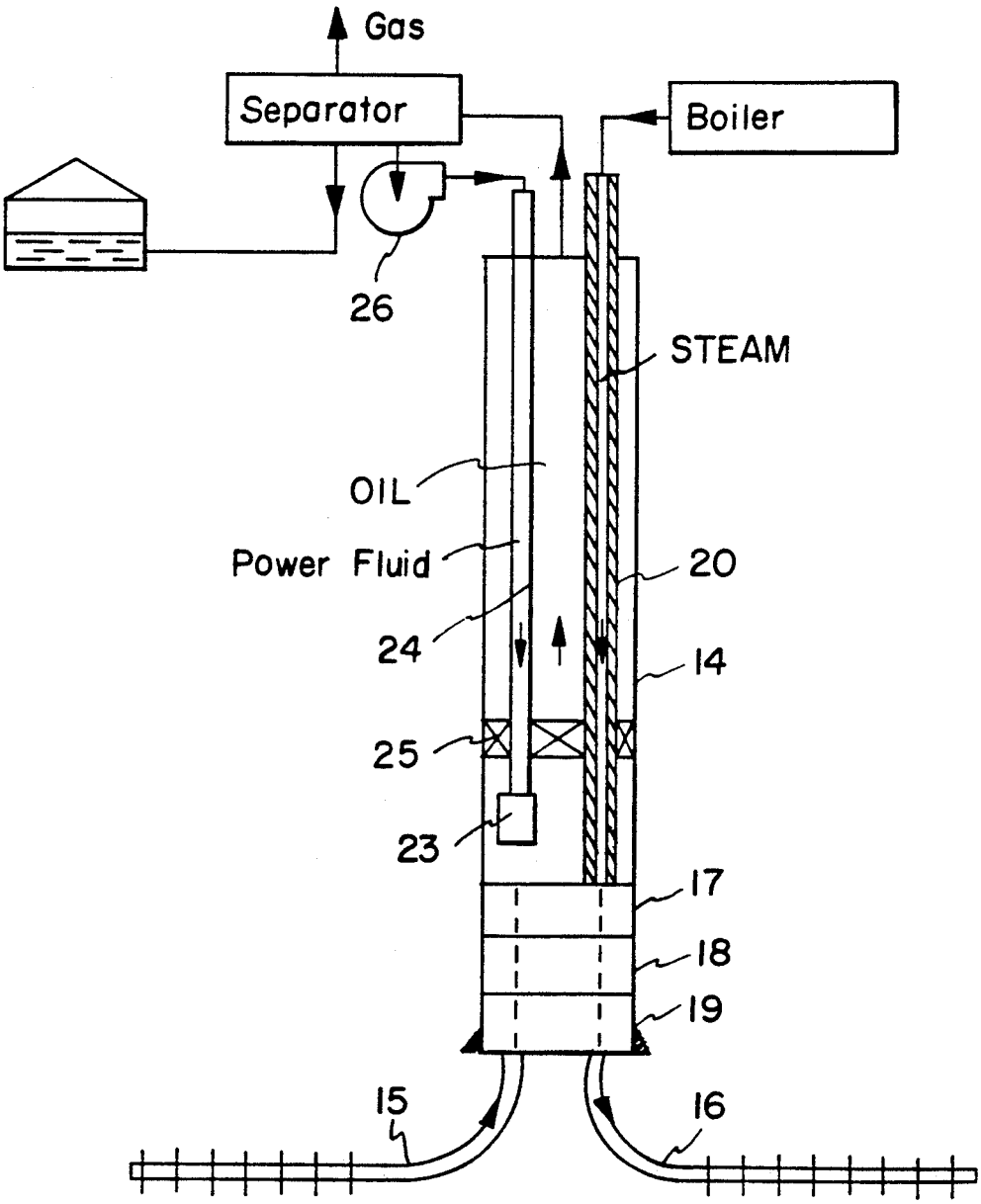
FIG. 3 is a vertical cross section showing the configuration of the tubular goods and downhole equipment in the vertical well for the first embodiment of the present process, where the produced fluids are gas-lifted to the surface.

COMPARISON OF MAJOR EQUIPMENT LISTS FOR FIG. 1 (PRIOR ART) VERSUS THOSE OF THE EMBODIMENTS OF FIG. 2 AND FIG. 3

Assumed: (a) 20 Ac. spacing
(b) Equivalent drilling costs in all cases

| FIG. 1 (PRIOR ART) | FIG. 2 | FIG. 3 |
|---|---|---|
| 2 Well heads | 1 Well head | 1 Well head |
| 2 Vertical Casings | 1 Vertical Casing | 1 Vertical Casing |
| 2 Tubings | 2 Tubings (parallel) | 2 Tubings (concentric) |
| 2 Steam lines | | |
| 2 Gas-lift lines | | |
| 1 Gas compressor | 1 Gas compressor | |
| 2 Flow lines | | |
| | | 1 Power fluid tubing |

TABLE 1-continued

COMPARISON OF MAJOR EQUIPMENT LISTS FOR FIG. 1 (PRIOR ART) VERSUS THOSE OF THE EMBODIMENTS OF FIG. 2 AND FIG. 3
Assumed: (a) 20 Ac. spacing
(b) Equivalent drilling costs in all cases

| FIG. 1 (PRIOR ART) | FIG. 2 | FIG. 3 |
|---|---|---|
| BASE CASE | SMALLER HEAT LOSSES<br>LESS THERMAL STRESS<br>HIGHER OIL RATE/WELL | 1 Pump<br>SMALLER HEAT LOSSES<br>LESS THERMAL STRESS<br>HIGHER OIL RATE/WELL |

A major equipment list is given on Table 1 for the cases of FIG. 1 to FIG. 3. It compares facilities for the same field under prior art versus those required when the field is operated under one embodiment of the present process. A single vertical cased well (14) is connected to at least two horizontal drainholes (15) and (16) draining the same portion of the reservoir as wells 6 and 7 in FIG. 1. Connection from the vertical casing to the liners of wells 15 and 16 is by means of a Downhole Valve Section (17), a connector (18) and a conventional multi-tubing completion packer (19). Steam generated in the boiler (1), preferably located in close proximity of the well head, is injected into the drainhole 16 through an insulated vertical tubing (20). The steam tubing insulation (21) is preferably of the Magnesium silicate foam type, which can be made in situ by a known process at a low cost. The reservoir fluids produced into the drainhole 15 are conveyed to the surface through an uninsulated production tubing (22) in which they are gas-lifted by means of dry gas conveyed through the annulus between the well casing and the two vertical tubings.

Conventional gas-lift valves (23) and a gas-lift compressor (10) complete the gas handling system. The reservoir fluids produced are again separated in separator facilities (9) and the oil is sent to the storage tank (12). It is essential that separated gas be dehydrated to preclude any condensation of liquid water against the cold casing wall, which would result in an increased heat transfer coefficient. The operation of this process may be described as follows: The steam heat loss through surface lines is negligible in view of their short length. The steam tubing heat loss is small because the thermal conductivity of the insulation layer is low and because the temperature gradient across that layer is reduced by the relatively high temperature, about 300° F., of the gas lift gas discharged at a high temperature from the compressor (10) and maintained at a high temperature by the heat transferred from the hot reservoir fluids through the uninsulated tubing wall (22). Heat is lost through the casing but the heat transfer coefficient from the dehydrated gas-lift gas, flowing at a low velocity against the casing wall, is relatively low and the temperature gradient from gas to the surrounding rocks is also relatively low. Most of the heat lost through the casing is supplied from the hot reservoir fluids flowing through the uninsulated production tubing.

The major equipment list (Table 1) of FIG. 2, compared to that of FIG. 1 shows significant capital cost savings on all surface lines. The savings due to drilling one vertical well instead of two are offset by the cost of drilling and completing the two drainholes. Both vertical tubings, each dedicated to a single type of fluid at known conditions, may be sized more accurately than those in FIG. 1, which must be capable of double duty.

FIG. 3 shows a second embodiment of the present process, where the produced reservoir fluids are brought to the surface through the annular space between the insulated steam tubing (20) and the casing (14). These fluids are lifted to the surface by means of a conventional hydraulic or jet pump (23), suspended to a power fluid line (24) below a conventional dual tubing completion packer (25) dividing the space filled with produced fluids into two separate compartments connected through the subsurface pump located below the packer. The gas-lift compressor is replaced by the high pressure pump (26) providing energy to the power fluid. Otherwise, the boiler and oil separation facilities are similar to those in the previous two cases except that the separator size must also accomodate the volume of power fluid mixed with the production stream. The power fluid may preferably be hot water discharged from the separator, suitably processed through appropriate filters. The thermal insulation layer on the steam tubing must be protected from the contact with the water-rich mixture flowing against its outer surface. For this reason a conventional dual wall insulated tubing is preferred.

The operation of this system, according to the present process, is similar in principle to that of FIG. 2. The heat loss to the surrounding rocks is supplied mainly by the hot produced fluids and by the hot power fluid. Steam heat losses are minimized by the insulation layer and the low temperature gradient across it.

Figure 4:
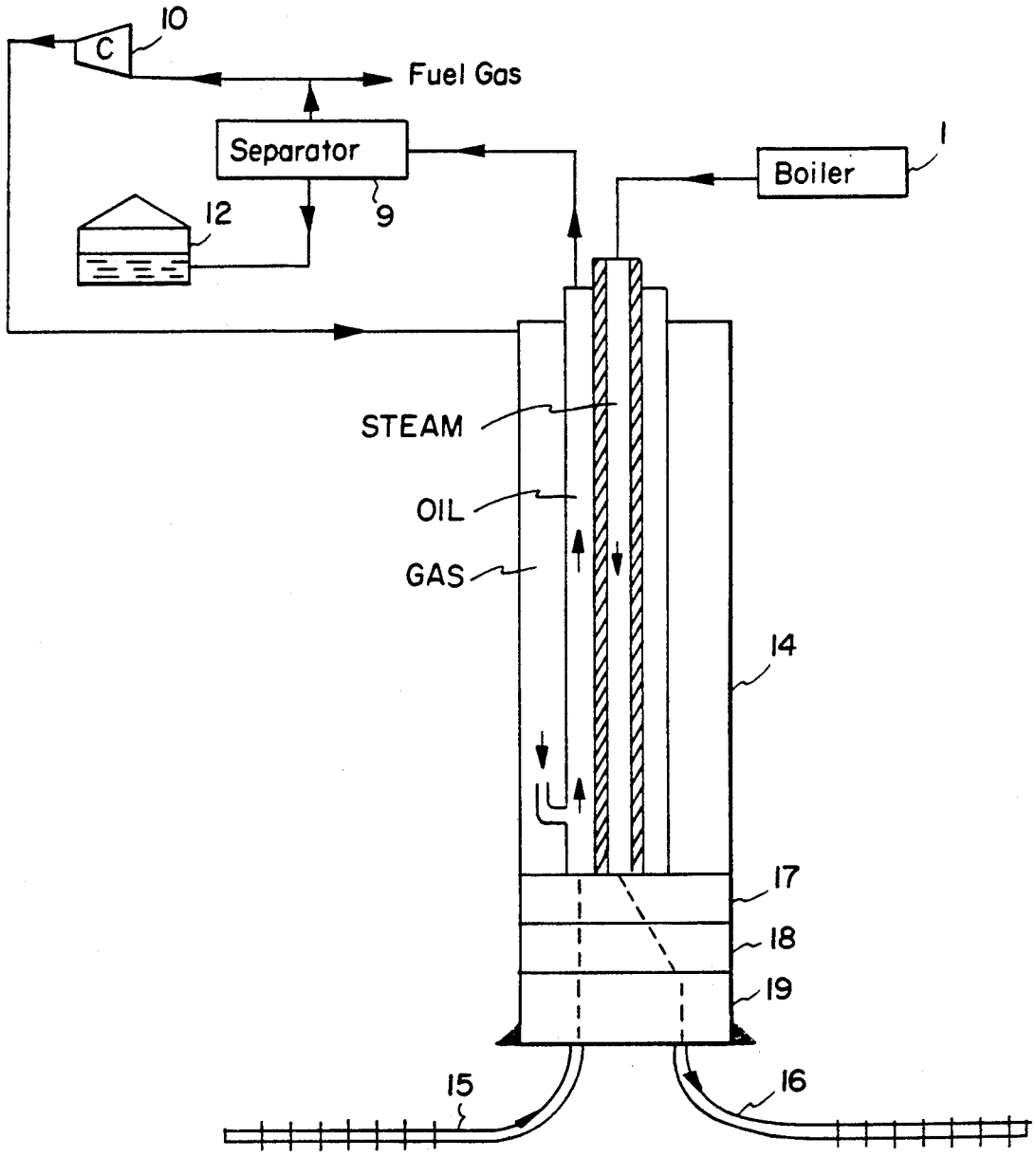
FIG. 4 is a vertical cross section showing the arrangement of the tubular goods and downhole equipment in a second embodiment, where the produced fluids are lifted to the surface by means of a hydraulic or jet pump.
Figure 5:
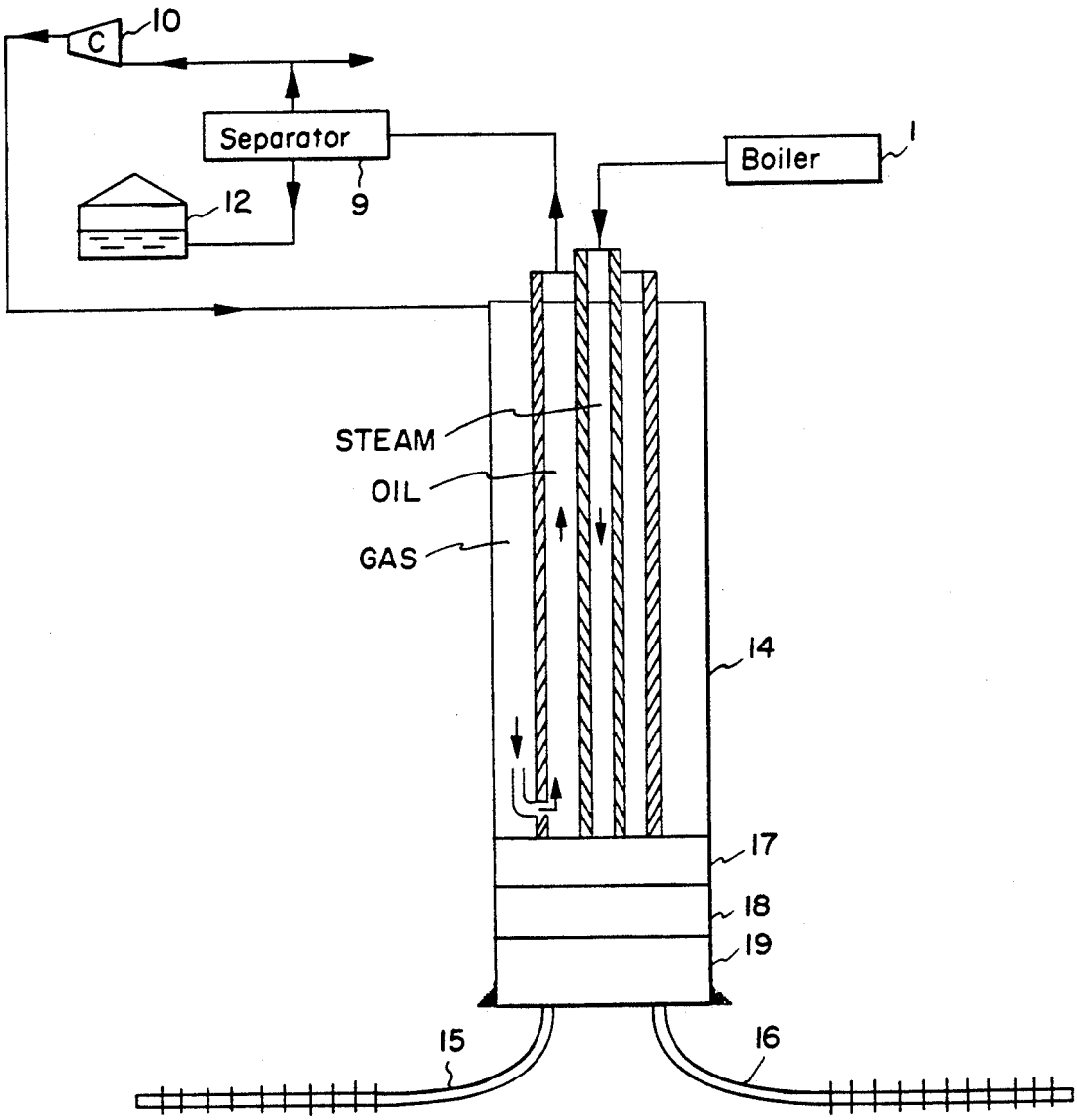
FIG. 5 is a vertical cross section showing the arrangement of the tubular goods and downhole equipment in a third embodiment, applicable to offshore wells in deep water.
Figure 6:
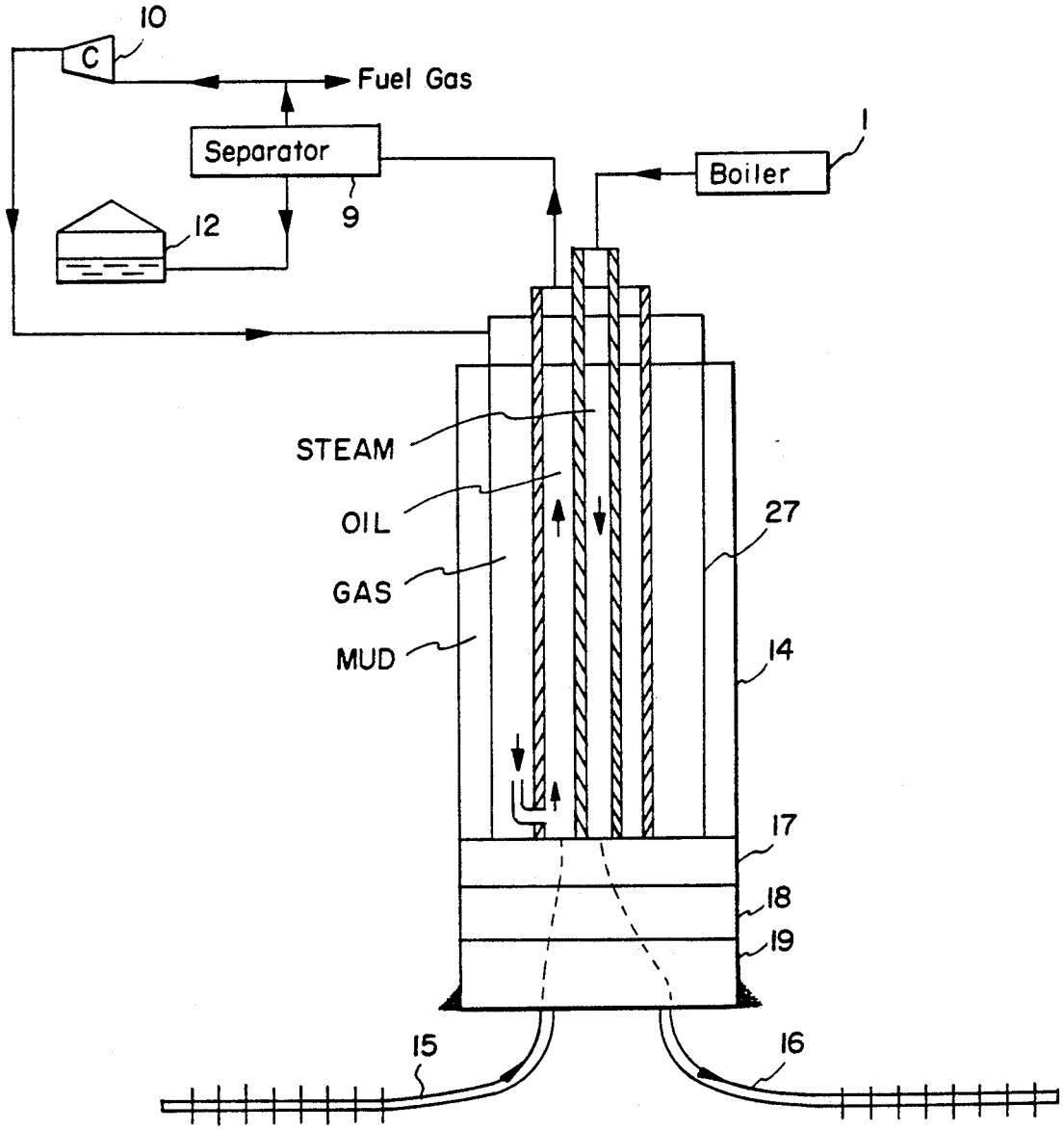
FIG. 6 is a vertical cross section showing the arrangement of the tubular goods and downhole equipment in a fourth embodiment, applicable to Arctic wells penetrating a thick Permafrost layer.

FIG. 4 shows a third embodiment in which the insulated steam tubing is located inside a production tubing. The produced fluids are gas-lifted to the surface. The gas-lift gas is injected in the annulus between casing and production tubing. The production tubing is equipped with conventional gas-lift valves. Surface facilities are the same as in FIG. 2. The insulated steam tubing is similar to that of FIG. 3. FIG. 5 shows a fourth embodiment applicable to offshore wells in deep water. The process configuration is the same as in FIG. 4, except that the production tubing is also insulated, preferably using the Magnesium silicate foam produced in situ. This inexpensive insulation requires, as in FIG. 2 that all moisture be eliminated from the gas compartment. FIG. 6 shows a fifth embodiment applicable to Arctic wells penetrating a thick layer of Permafrost. The process configuration is similar to that of FIG. 4, except that the gas-lift gas is contained in the annulus between a double-walled insulated production tubing and another concentric tubing (27). The annulus between this last tubing and the casing is filled with stagnant thixotropic mud presenting a low thermal conductivity, due to the lack of convection. This is known as Arctic Pack mud. As in FIG. 4, the steam heat loss is minimized by the insulation layer and by the low temperature gradient across it. The heat loss through the casing is minimized by the Arctic Pack mud, the low heat transfer coefficient between low-velocity gas-lift gas and the mud and by the insulation layer of the production tubing. The necessity of preventing the Permafrost from melting precludes the use of Magnesium silicate foam insulation, which is made by boiling in situ a concentrated solution. This operation would be detrimental to the Permafrost.

Those skilled in the art will see that other combinations, using for instance hydraulic or jet pumps powered by tepid water in an insulated power fluid line would accomplish the same purpose. Handling of dry gas being easier in an Arctic climate than handling large volumes of tepid water, the previous approach of FIG. 5 was preferred, but this does not exclude any application of the present process in which hydraulic or jet pumps are used, even in the Arctic.

It will also be apparent to those skilled in the art that other types of pumps, such as the hydraulically-operated, rod-driven, progressive cavity type of pump, may also be used for the same purpose. The connection between the drainholes and the vertical casing in FIG. 2 to 6 is through the bottom of the casing.

Figure 7:
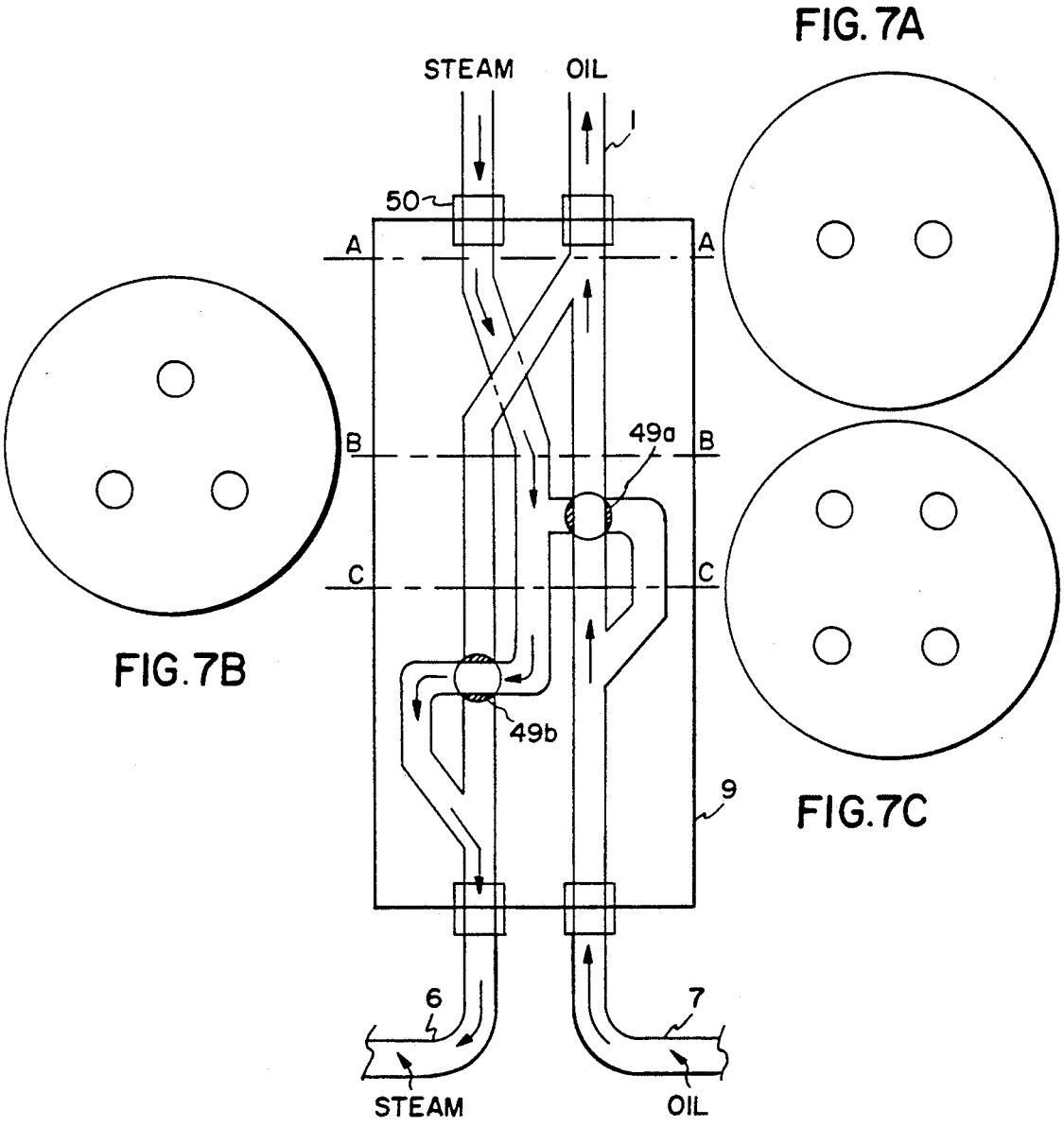
Figures 8A, 8B, 8C, 8D:
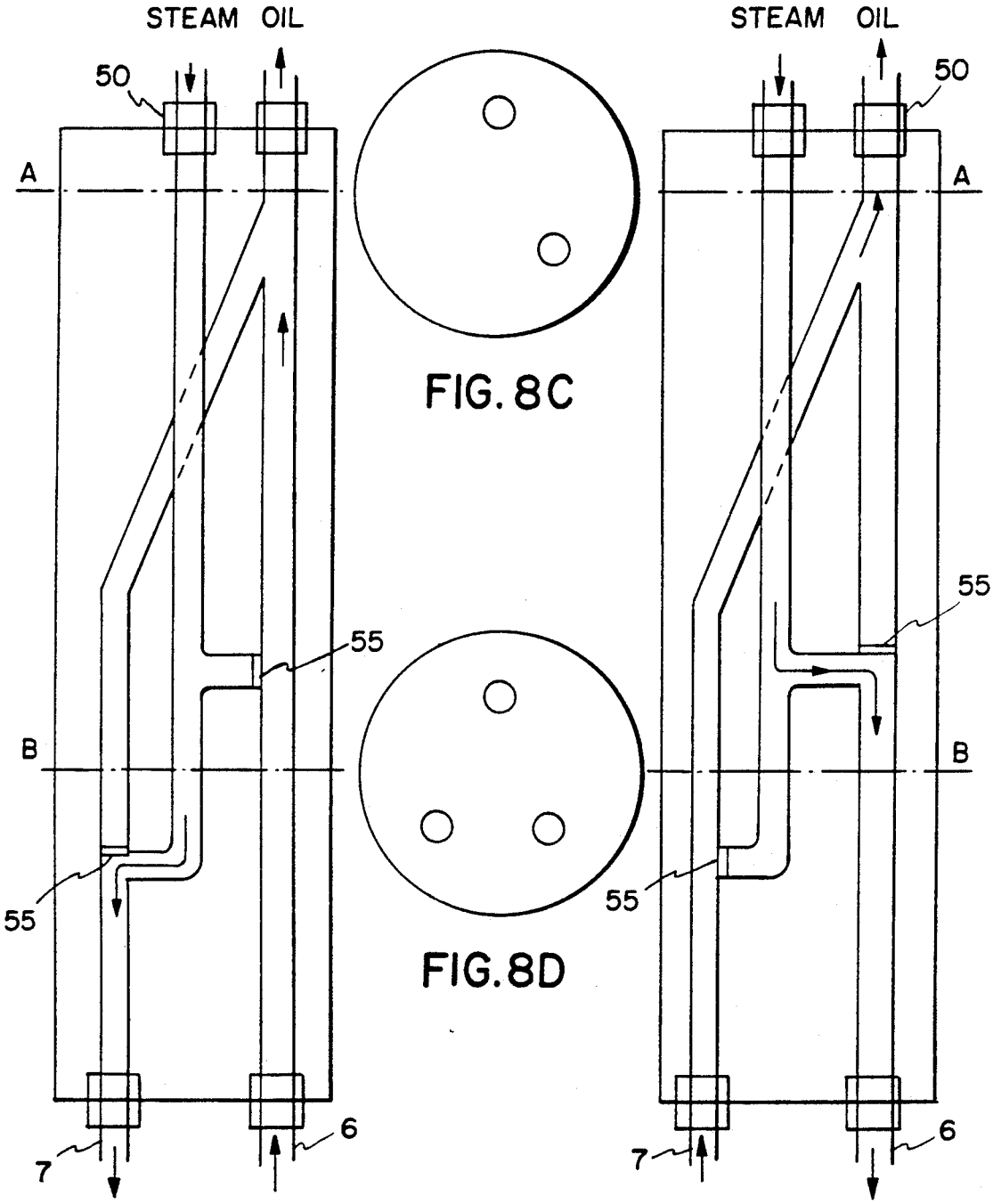

FIGS. 7 and 8 are fully described in the companion application Ser. No. 510,596. Both of them show Downhole Valve Sections consisting of tubular flow paths connected respectively to the steam tubing and to the production tubing a the top and to a pair of drainholes at the bottom. Within two branched vertical flowpaths connected to one of the tubings (in these two figures, the production tubing) are located some novel two-way surface operated valves, directing the flow either vertically or horizontally. In FIG. 7 the valves are of the ball type, and in FIGS. 8*a* and 8*b*, they are of the flapper type.

It will be apparent to those skilled in the art that the branched flowpaths could indifferently be connected to either one of the two tubings, without affecting the operation of the Downhole Valve Section. It is also apparent that more than one pair of drainholes could be connected to the branched flowpaths, provided that additional horizontal flowpaths be provided, intersecting the branched flowpaths and connected to the other tubing (steam tubing in these figures). The number of such horizontal flowpaths is equal to twice the number of drainhole pairs. A two-way valve is located at the intersection of the horizontal paths with the branched vertical paths. Consequently, the number of two-way valves required is always equal to the number of drainholes. Each valve is located at a different depth, so that it can easily be identified by known wireline techniques. This is particularly useful when wireline-retrievable valves are used. The horizontal cross sections 7*a*, 7*b*, 7*c*, 8*c* and 8*d* show that the number of vertical flowpaths required at any depth within the Downhole Valve Section does not exceed 4 (or 3 in the case of flapper-type valves and only two drainholes).

Figure 9:
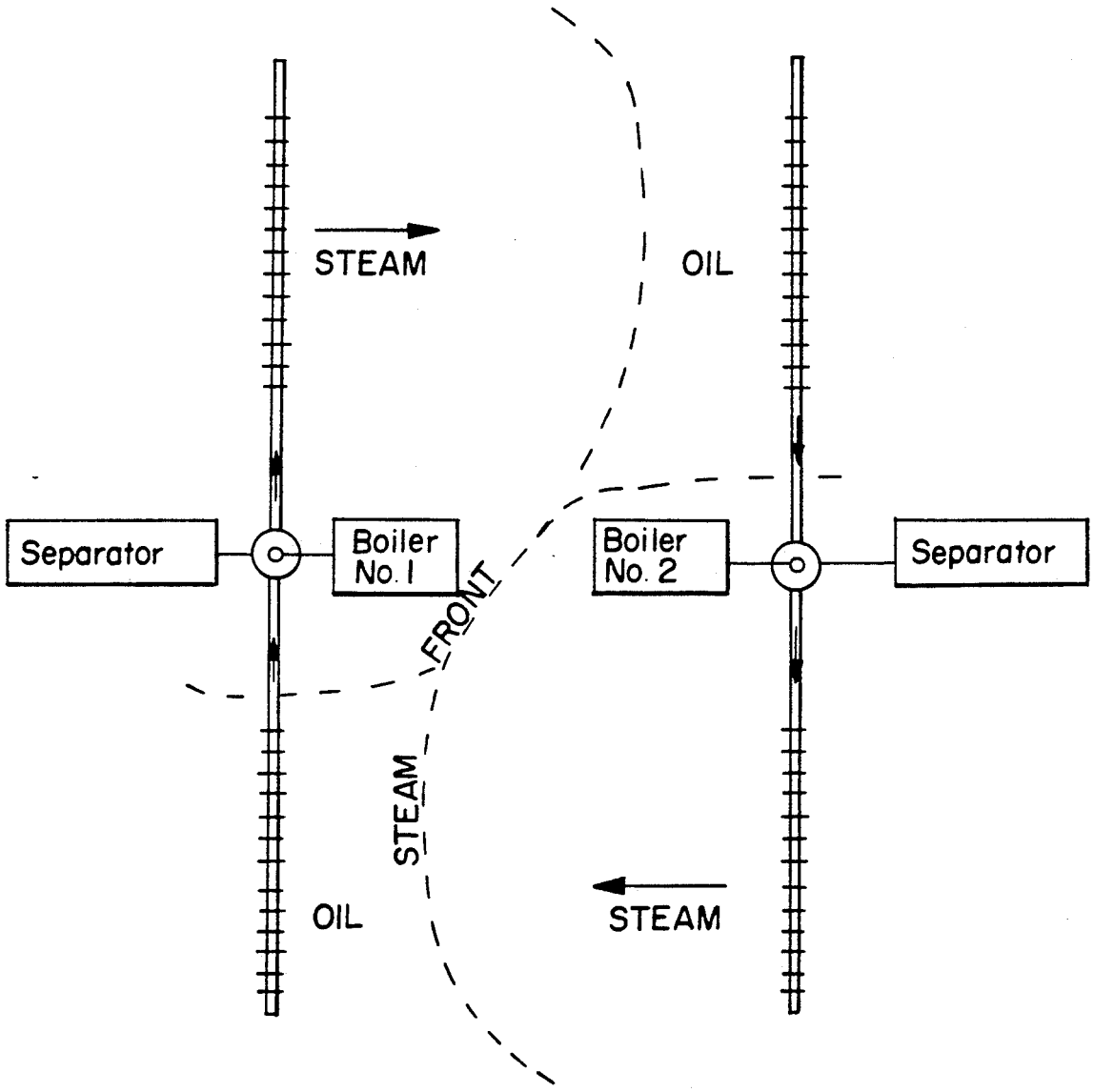
FIG. 9 is a plan view of two similar vertical wells connected each to two horizontal drainholes within the same oil zone equipped as in FIGS. 2 to 6 are operated as a steam flood, with the Downhole Valve Section remaining in a fixed mode of flow distribution.

FIG. 9 is a map showing two vertical wells, each one connected to two substantially horizontal drainholes of the type shown in FIG. 2 to 6. The Downhole Valve Sections in both wells are no longer operated and the flow paths now remain unchanged for operation of a steam flood. The steam front advancing between opposite drainholes of the two vertical wells is also shown.

I claim:

1. A process for reducing the degradation of the quality of steam cyclically injected into Heavy Oil reservoirs in which a cased vertical well is connected to a plurality of substantially horizontal drainholes, comprising subjecting each of said drainholes to cyclic steam injection and oil production, one after the other and sequentially connecting said drainholes through a Downhole Valve Section to an insulated steam tubing and to a production tubing carrying hot reservoir fluids to the surface, mixed with a warm lifting fluid supplied from the surface.

2. A process according to claim 1, wherein the lifting fluid is a dehydrated and compressed gas located within the annular space between the well casing and both tubings.

3. A process according to claim 1 wherein the lifting fluid is a liquid powering a hydraulically-powered pump located below a packer dividing into two separate compartments the space filled with produced fluids and wherein said power liquid is conveyed to the pump from the surface through the annular space between the well casing and both tubings and said liquid, mixed with produced fluids, is discharged from the pump into the uppermost of said two compartments.

4. A process according to claim 1 wherein the lifting fluid is a liquid operating a jet pump located below a packer dividing into two separate compartments the space filled with produced fluids and wherein said liquid is conveyed to the pump from the surface through the annular space between the well casing and both tubings and said liquid, mixed with produced fluids is discharged from the pump into the uppermost of said two compartments.

5. A process according to claim 1 wherein the lifting fluid is conveyed by a tubing parallel to the steam tubing.

6. A process according to claim 1 wherein the well casing also serves as production tubing and wherein a packer divides the casing-tubing annular space into two compartments connected only through a pump and wherein the lowermost compartment contains the Downhole Valve Section.

7. A process according to claim 1 wherein at least two of the tubings are parallel.

8. A process according to claim 1 wherein the steam tubing is inside and substantially concentric with the production tubing.

9. A process according to claim 1 wherein the concentric production tubing is insulated and separated from the well casing by compressed dehydrated gas used for gas-lifting the production tubing stream.

10. A process according to claim 1 or 9 wherein the compressed gas is contained within a tubing concentric with the insulated production tubing and surrounding it, while the annular space between said gas tubing and the well casing is mud-filled.

11. A process according to claim 1, 3 or 8, wherein the lifting fluid powering said pump is located within the annular space between said production tubing and an outer tubing, concentric with the production tubing and with the steam tubing, which are both insulated, and wherein the annular space between said outer tubing and the well casing is mud-filled.

12. A process according to claim 1, 4 or 8, wherein said jet pump liquid is located within the annular space between said production tubing and an outer tubing, concentric with the production tubing and with the steam tubing, which are both insulated, and wherein the annular space between said outer tubing and the well casing is mud-filled.

13. A process according to claim 1 wherein said drainholes are connected to the bottom of said vertical cased well by means of a multi-tubing packer.

14. A process according to claim 1, 3 or 4 wherein said drainholes are connected to said vertical cased well through windows milled into the casing and wherein the lowermost of said compartments, filled with produced fluids, extends below the Downhole Valve Section.

15. A process according to claim 3, 4 or 6 wherein said pump is located in the lowermost of said compartments between said packer and the Downhole Valve Section.

16. A process according to claim 3, 4 or 6 wherein said pump is located in the lowermost of said compartments and below the Downhole Valve Section.

* * * * *